United States Patent [19]

Yamamoto

[11] 4,155,318

[45] May 22, 1979

[54] LOOPER FOR TUFTING MACHINES

[76] Inventor: Yoshio Yamamoto, 204-3, Nawate-cho, Kashihara-shi Nara-ken, Japan

[21] Appl. No.: 881,771

[22] Filed: Feb. 27, 1978

[30] Foreign Application Priority Data

Jun. 2, 1977 [JP] Japan ..... 52/65525

[51] Int. Cl.[2] ..... D05C 15/22

[52] U.S. Cl. ..... 112/79 R; 83/355

[58] Field of Search ..... 112/79 R, 79 A, 79 FF, 112/79.5; 83/356.3, 355

[56] References Cited

U.S. PATENT DOCUMENTS

| | | | |
|---|---|---|---|
| 2,800,096 | 7/1957 | Signoret | 112/79 R |
| 3,152,563 | 10/1964 | Broadrick | 112/79 R |
| 3,732,771 | 5/1973 | Kinoshita et al. | 83/355 |
| 3,779,123 | 12/1973 | Chafee | 83/356.3 |

FOREIGN PATENT DOCUMENTS

| | | | |
|---|---|---|---|
| 2341567 | 2/1975 | Fed. Rep. of Germany | 112/79 R |

*Primary Examiner*—Henry Jaudon

*Attorney, Agent, or Firm*—George B. Oujevolk

[57] ABSTRACT

A looper comprising a looper main body of steel and a blade of cemented carbide alloy. The looper main body includes a mounting portion, a vertical portion provided at the right end of the mounting portion, a horizontal portion extending from the upper end of the vertical portion horizontally rightward and a tip portion extending downward from the right end of the horizontal portion. The blade is attached to a continuous hook-shaped recessed portion formed in the main body and defined by the inner edges of the vertical portion, the horizontal portion and the tip portion. The looper is highly resistant to wear, flexible, inexpensive to manufacture and capable of efficiently cutting chemical fibers which are difficult to cut.

1 Claim, 9 Drawing Figures

LOOPER FOR TUFTING MACHINES

BACKGROUND OF THE INVENTION

This invention relates to a looper for the manufacture of tufted carpets on tufting machines.

As already known, the tufts on tufted carpets are formed on a tufting machine by stitching pile yarns into a backing fabric, drawing out the pile yarns by the tips of loopers arranged as opposed to the needles to form loops, and cutting the top of the loops with the blades of the loopers.

For the tufting of a backing fabric as described above, tufting machines are provided with 1,000 to 1,800 pairs of needles and loopers which are arranged side by side and by which a low of tufts is formed instantaneously. This operation is repeated in succession to form tufts over the fabric.

When it becomes necessary to replace and adjust even a single looper among a large number of loopers on the tufting machine, the machine must wholly be brought out of operation and requires about 70 hours in total for the replacement and adjustment before a stable operation is resumed.

Accordingly one skilled in the art makes constant efforts at the maintenance of various parts to assure the proper operation of the tufting machine at all times. However wear on the blades of the loopers inevitably occurs.

As materials for tufts on tufted carpets, wool, acrylic fibers and like materials which are most easy to cut were used in the past. Loopers wholly made of steel as shown in FIGS. 1 and 2 were fully serviceable for such materials.

However, chemical fibers as of polypropylene and nylon which are difficult to cut have been introduced into wide use in recent years. When used for these fibers loopers of the all steel type wear rapidly and require frequent replacement. This is seriously disadvantageous for the stable operation of the tufting machine as stated above, greatly reducing the operation efficiency of the machine.

It has therefore been strongly desired to provide a looper having increased resistance to wear and a higher cutting ability. Improved loopers available include those having a head portion which is made entirely of cemented carbide alloy as shown in FIGS. 3 and 4 and those incorporating a cemented carbide alloy insert as seen in FIGS. 5 and 6.

The looper of the former type has a head portion 1 made of cemented carbide alloy and attached by silver soldering to a base portion, namely a mounting portion 2 of steel. Whereas this looper is usable for a prolonged period of time even for cutting chemical fibers, the head portion 1 which is made of cemented carbide alloy has no elasticity, tends to break and is liable to separate at the soldered portion 3. Moreover the looper needs an expensive material, is difficult to make and requires skill in handling, hence various drawbacks.

The looper of the latter type has a cemented carbide insert incorporated in part of the head portion 4, namely in a vertical blade portion 5 and a horizontal blade portion 7 except its right end 6. Although the cemented carbide alloy portions 5 and 7 are less susceptible to wear, the mounting portion 8 and head portion 4 which are made of steel wear rapidly where they adjoin the alloy portions, with the resulting drawback that a step 9 as seen in FIG. 7 will be formed during use. The step 9 will engage yarns and produce a flaw in the product, entailing the necessity for the replacement of the looper while the blade is still sharp-edged.

SUMMARY OF THE INVENTION

The main object of this invention is to overcome the foregoing drawbacks of conventional loopers.

Stated more specifically, a first object of this invention is to provide an improved looper having a high ability to cut materials such as chemical fibers which are difficult to cut as well as wool and like materials which can be cut with ease.

A second object of this invention is to provide an improved looper having high resistance to wear.

A third object of this invention is to provide an improved looper having elasticity and resistance to breakage.

A fourth object of this invention is to provide an improved looper with which tufting machines can be operated with a greatly improved efficiency.

To fulfil the above objects, this invention provides a looper for tufting machines comprising a looper main body made of steel and a blade made of cemented carbide alloy, the looper main body including a mounting portion, a vertical portion provided at the right end of the mounting portion, a horizontal portion extending from the upper end of the vertical portion horizontally rightward and a tip portion extending downward from the right end of the horizontal portion, the looper main body being formed with a continuous hook-shaped recessed portion defined by the inner edges of the vertical portion, the horizontal portion and the tip portion, the cemented carbide alloy blade substantially conforming to the shape of the hook-shaped recessed portion and being attached to the hook-shaped recessed portion.

According to the preferred embodiment of this invention, the downwardly extending tip portion of the looper main body made of steel has a high hardness, the horizontal portion has a slightly lower hardness, and the vertical portion and mounting portion have a further lower hardness.

The objects and features of this invention will become more apparent from the following detailed description and accompanying drawings.

DETAILED DESCRIPTION

Figure 1:
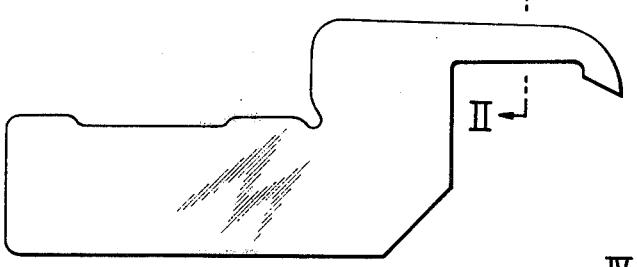
FIG. 1 PRIOR ART
FIG. 1 is a front view showing a known looper.
Figure 2:
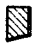
FIG. 2 PRIOR ART
FIG. 2 is a view in section taken along the line II—II in FIG. 1.
Figure 3:
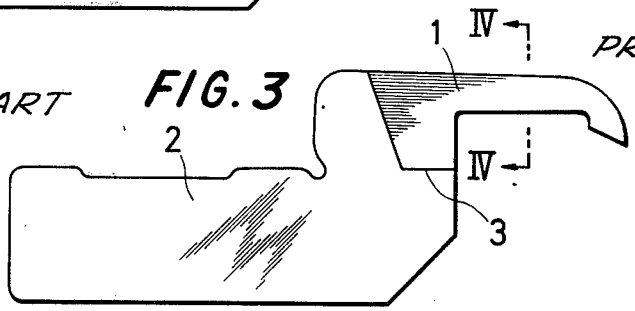
FIG. 3 PRIOR ART
FIG. 3 is a front view of another known looper.
Figure 4:
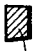
FIG. 4 PRIOR ART
FIG. 4 is a view in section taken along the line IV—IV in FIG. 3.
Figure 5:
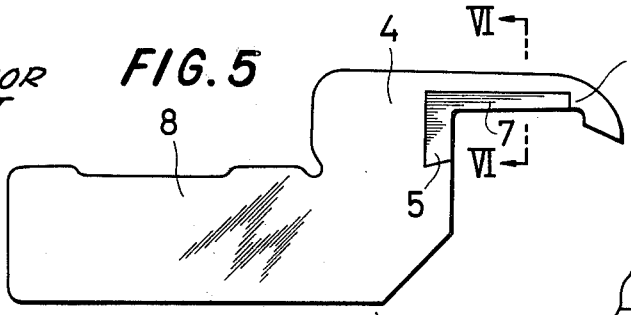
FIG. 5 PRIOR ART
FIG. 5 is a front view of another known looper.
Figure 6:
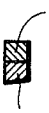
FIG. 6 PRIOR ART
FIG. 6 is a view in section taken along the line VI—VI in FIG. 5.
Figure 7:
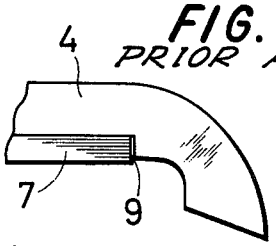
FIG. 7 PRIOR ART
FIG. 7 is a fragmentary enlarged view of the looper shown in FIG. 5 and having a step produced during use.
Figure 8:
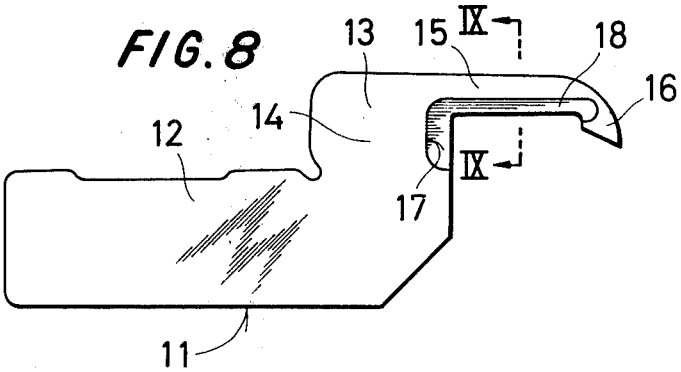
FIG. 8 is a front view showing an embodiment of the looper of this invention for tufting machines.
Figure 9:
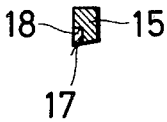
FIG. 9 is a view in section taken along the line IX—IX in FIG. 8.

FIGS. 8 and 9 show a looper main body 11 made of steel and comprising a mounting portion 12 to be mounted on a tufting machine and a head portion 13 extending from the mounting portion 12. The head portion 13 includes a vertical portion 14 provided at the right end of the mounting portion 12, a horizontal portion 15 extending from the upper end of the vertical portion 14 horizontally rightward and a tip portion 16 extending downward from the right end of the horizontal portion 15. A continuous hook-shaped recessed portion 17 is defined by the inner edges of the vertical portion 14, horizontal portion 15 and downwardly extending tip portion 16.

Preferably the hook-shaped recessed portion 17 has such a length that it extends from the upper portion of the vertical portion 14 of the looper main body 11 through the horizontal portion 15 to the upper portion of the downwardly tip portion 16.

A blade 18 made of cemented carbide alloy and substantially conforming to the shape of the hooked recessed portion 17 is attached to the hook-shaped recessed portion 17 as by silver soldering.

The portions of the steel looper main body 11 of the above construction have been hardened to the desired hardnesses. For example, the downwardly extending tip portion 16 which will come into contact with the needle tip must have a high hardness of HV 800, the horizontal portion 15 has a hardness of HV 700, and the part including the horizontal portion 14 and the mounting portion 12 needs to have a low hardness of HV 250 to facilitate the adjustment of the tip portion 16 relative to the needle. (The term "HV" above refers to Vickers hardness.)

As described above, the looper of this invention for tufting machines comprises a looper main body made of steel and having toughness and flexibility and a blade of cemented carbide alloy having high wear resistance and attached to part of the main body of minimum area essential to cutting. Thus the looper has the advantages of those made of steel and those made of cemented carbide alloy, namely advantages of being free of various drawbacks of the known loopers described, usable for a prolonged period of time for any chemical fibers as of polypropylene or nylon, easy to handle and adjust because of its flexibility, and easy and inexpensive to manufacture.

Although this invention has been described above with reference to a specific embodiment, other changes and modifications may be made without departing from the scope of the invention as defined in the appended claims.

What is claimed is:

1. A looper for tufting machines comprising a looper main body made of steel and a blade made of cemented carbide alloy, the looper main body including a mounting portion, a vertical portion provided at the right end of the mounting portion, a horizontal portion extending from the upper end of the vertical portion horizontally rightward and a tip portion extending downward from the right end of the horizontal portion, the looper main body being formed with a continuous hook-shaped recessed portion defined by the inner edges of the vertical portion, the horizontal portion and the tip portion, the cemented carbide alloy blade substantially conforming to the shape of the hook-shaped recessed portion and being attached to the hook-shaped recessed portion, said downwardly extending tip portion of the looper main body being made of steel having a high hardness, the horizontal portion having a slightly lower hardness, and the vertical portion and mounting portion having a further lower hardness.

* * * * *